US008963784B2

(12) United States Patent
Zhu et al.

(10) Patent No.: US 8,963,784 B2
(45) Date of Patent: Feb. 24, 2015

(54) ANTENNA WITH FOLDED MONOPOLE AND LOOP MODES

(75) Inventors: Jiang Zhu, Sunnyvale, CA (US); Qingxiang Li, Mountain View, CA (US); Rodney A. Gomez Angulo, Sunnyvale, CA (US); Robert W. Schlub, Cupertino, CA (US); Ruben Caballero, San Jose, CA (US)

(73) Assignee: Apple Inc., Cupertino, CA (US)

( * ) Notice: Subject to any disclaimer, the term of this patent is extended or adjusted under 35 U.S.C. 154(b) by 0 days.

(21) Appl. No.: 13/402,831

(22) Filed: Feb. 22, 2012

(65) Prior Publication Data

US 2013/0214986 A1 Aug. 22, 2013

(51) Int. Cl.
*H01Q 1/24* (2006.01)

(52) U.S. Cl.
USPC ..... 343/702; 343/846; 343/848

(58) Field of Classification Search
USPC ..... 343/702, 833, 834, 841, 846, 848
See application file for complete search history.

(56) References Cited

U.S. PATENT DOCUMENTS

| | | | | |
|---|---|---|---|---|
| 7,315,289 | B2 * | 1/2008 | Puente Baliarda et al. | 343/817 |
| 7,656,353 | B2 * | 2/2010 | Qi et al. | 343/702 |
| 7,692,595 | B2 | 4/2010 | Kim | |
| 2009/0066586 | A1 | 3/2009 | Rao et al. | |
| 2009/0128446 | A1 | 5/2009 | Gummalla et al. | |
| 2009/0303143 | A1 | 12/2009 | Miyoshi | |
| 2011/0050508 | A1 | 3/2011 | Guterman et al. | |

FOREIGN PATENT DOCUMENTS

| | | |
|---|---|---|
| WO | 2004025778 | 3/2004 |
| WO | 2008059509 | 5/2008 |
| WO | 2011005518 | 1/2011 |
| WO | 2011022117 | 2/2011 |

OTHER PUBLICATIONS

Hongfei Hu, U.S. Appl. No. 13/366,142, filed Feb. 3, 2012.

* cited by examiner

*Primary Examiner* — Hoang V Nguyen
(74) *Attorney, Agent, or Firm* — Treyz Law Group; G. Victor Treyz; David C. Kellogg

(57) ABSTRACT

Electronic devices may be provided that contain wireless communications circuitry. The wireless communications circuitry may include radio-frequency transceiver circuitry and antennas. An antenna may have an antenna ground that is configured to form a cavity for the antenna. The antenna ground may be formed on a support structure. The antenna ground may have an opening. The support structure may have a planar surface on which the opening is formed. A folded monopole antenna resonating element and an L-shaped conductive antenna element may be formed in the opening and may be capacitively coupled. The folded monopole antenna resonating element may have an end at which a positive antenna feed terminal is formed. A ground antenna feed terminal may be formed on the antenna ground. A segment of the antenna ground may extend between the ground antenna feed terminal and an end of the L-shaped conductive antenna element.

24 Claims, 9 Drawing Sheets

ANTENNA WITH FOLDED MONOPOLE AND LOOP MODES

BACKGROUND

This relates generally to electronic devices, and more particularly, to antennas for electronic devices.

Electronic devices such as portable computers and cellular telephones are often provided with wireless communications capabilities. For example, electronic devices may use long-range wireless communications circuitry such as cellular telephone circuitry to communicate using cellular telephone bands. Electronic devices may use short-range wireless communications circuitry such as wireless local area network communications circuitry to handle communications with nearby equipment. Electronic devices may also be provided with satellite navigation system receivers and other wireless circuitry.

To satisfy consumer demand for small form factor wireless devices, manufacturers are continually striving to implement wireless communications circuitry such as antenna components using compact structures. At the same time, it may be desirable to include conductive structures in an electronic device such as metal device housing components and electronic components. Because conductive components can affect radio-frequency performance, care must be taken when incorporating antennas into an electronic device that includes conductive structures. For example, care must be taken to ensure that the antennas and wireless circuitry in a device are able to exhibit satisfactory performance over a range of operating frequencies.

It would therefore be desirable to be able to provide wireless electronic devices with improved antenna structures.

SUMMARY

Electronic devices may be provided that contain wireless communications circuitry. The wireless communications circuitry may include radio-frequency transceiver circuitry and antennas.

An antenna may have an antenna ground. The antenna ground may be configured to form a cavity for the antenna. The antenna ground may be supported by a dielectric support structure. The antenna ground may have an opening such as a rectangular opening. The support structure may have a surface on which the opening is formed.

A folded monopole antenna resonating element and an L-shaped conductive antenna element such as a bent strip of conductor may be formed in the opening. The folded monopole antenna resonating element and the conductive antenna element may be formed from conductive traces on a printed circuit or other substrate and may have segments that run parallel to each other. The parallel segments may be separated by a gap to produce a capacitance. The capacitance may capacitively couple the folded monopole antenna resonating element and the conductive antenna element.

The folded monopole antenna resonating element may have an end at which a positive antenna feed terminal is formed. A ground antenna feed terminal may be formed on the antenna ground adjacent to the positive antenna feed terminal. A segment of the antenna ground may extend between the ground antenna feed terminal and an end of the L-shaped conductive antenna element that terminates at the antenna ground.

The monopole antenna resonating element and conductive antenna structures may be configured to exhibit at least one monopole antenna resonance associated with the folded monopole antenna resonating element and at least one loop antenna resonance associated with a loop formed from the folded monopole antenna resonating element, the capacitively coupled bent strip of metal, and the segment of the antenna ground. The antenna may, for example, exhibit a monopole antenna resonance in a low-frequency communications band and may exhibit a resonance in a high-frequency communications band that is associated with a monopole antenna resonance and a harmonic loop antenna mode.

Further features of the invention, its nature and various advantages will be more apparent from the accompanying drawings and the following detailed description of the preferred embodiments.

DETAILED DESCRIPTION

Figure 1:
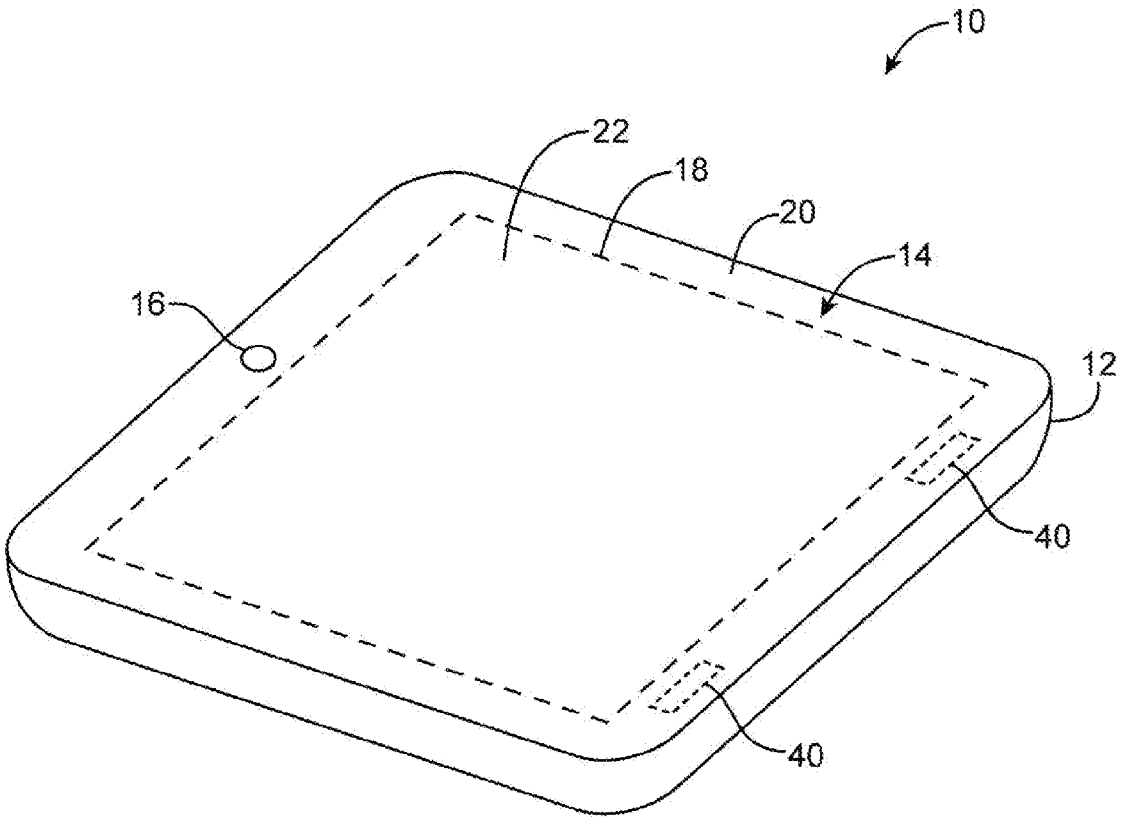
FIG. 1 is a perspective view of an illustrative electronic device with wireless communications circuitry in accordance with an embodiment of the present invention.

Electronic devices such as electronic device 10 of FIG. 1 may be provided with wireless communications circuitry. The wireless communications circuitry may be used to support wireless communications in multiple wireless communications bands. The wireless communications circuitry may include one or more antennas.

The antennas can be formed from conductive structures on printed circuit boards or other dielectric substrates. If desired, conductive structures for the antennas may be formed from conductive electronic device structures such as portions of conductive housing structures. Examples of conductive housing structures that may be used in forming an antenna include conductive internal support structures such as sheet metal structures and other planar conductive members, conductive housing walls, a peripheral conductive housing member such as a display bezel, peripheral conductive housing structures such as conductive housing sidewalls, a conductive planar rear housing wall and other conductive housing walls, or other conductive structures. Conductive structures for antennas may also be formed from parts of electronic components, such as switches, integrated circuits, display module structures, etc. Shielding tape, shielding cans, conductive foam, and other conductive materials within an electronic device may also be used in forming antenna structures.

Antenna structures may be formed from patterned metal foil or other metal structures. If desired, antenna structures may be formed from conductive traces such as metal traces on a substrate. The substrate may be a plastic support structure or other dielectric structure, a rigid printed circuit board substrate such as a fiberglass-filled epoxy substrate (e.g., FR4), a flexible printed circuit ("flex circuit") formed from a sheet of polyimide or other flexible polymer, or other substrate material. If desired, antenna structures may be formed using combinations of these approaches. For example, an antenna may be formed partly from metal traces (e.g., ground conductor) on a plastic support structure and partly from metal traces on a printed circuit (e.g., patterned traces for forming antenna resonating element structures).

The housing for electronic device 10 may be formed from conductive structures (e.g., metal) or may be formed from dielectric structures (e.g., glass, plastic, ceramic, etc.). Antenna windows formed from plastic or other dielectric material may, if desired, be formed in conductive housing structures. Antennas for device 10 may be mounted so that the antenna window structures overlap the antennas. During operation, radio-frequency antenna signals may pass through the dielectric antenna windows and other dielectric structures in device 10. If desired, device 10 may have a display with a cover layer. Antennas for device 10 may be mounted so that antenna signals pass through the display cover layer.

Electronic device 10 may be a portable electronic device or other suitable electronic device. For example, electronic device 10 may be a laptop computer, a tablet computer, a somewhat smaller device such as a wrist-watch device, pendant device, headphone device, earpiece device, or other wearable or miniature device, a cellular telephone, or a media player. Device 10 may also be a television, a set-top box, a desktop computer, a computer monitor into which a computer has been integrated, or other suitable electronic equipment.

Device 10 may have a display such as display 14 that is mounted in a housing such as housing 12. Display 14 may, for example, be a touch screen that incorporates capacitive touch electrodes or may be insensitive to touch. A touch sensor for display 14 may be formed from capacitive touch sensor electrodes, a resistive touch array, touch sensor structures based on acoustic touch, optical touch, or force-based touch technologies, or other suitable touch sensors.

Display 14 may include image pixels formed from light-emitting diodes (LEDs), organic LEDs (OLEDs), plasma cells, electrowetting pixels, electrophoretic pixels, liquid crystal display (LCD) components, or other suitable image pixel structures. A cover layer may cover the surface of display 14. The cover layer may be formed from a transparent glass layer, a clear plastic layer, or other transparent member. As shown in FIG. 1, openings may be formed in the cover layer to accommodate components such as button 16.

Display 14 may have an active portion and, if desired, may have an inactive portion. The active portion of display 14 may contain active image pixels for displaying images to a user of device 10. The inactive portion of display 14 may be free of active pixels. The active portion of display 14 may lie within a region such as central rectangular region 22 (bounded by rectangular outline 18). Inactive portion 20 of display 14 may surround the edges of active region 22 in a rectangular ring shape.

In inactive region 20, the underside of the display cover layer for display 14 may be coated with an opaque masking layer. The opaque masking layer may be formed from an opaque material such as an opaque polymer (e.g., black ink, white ink, a coating of a different color, etc.). The opaque masking layer may be used to block interior device components from view by a user of device 10. The opaque masking layer may, if desired, be sufficiently thin and/or formed from a sufficiently non-conductive material to be radio transparent. This type of configuration may be used in configurations in which antenna structures are formed under inactive region 20. As shown in FIG. 1, for example, antenna structures such as one or more antennas 40 may be mounted in housing 12 so that inactive region 20 overlaps the antenna structures.

Housing 12, which may sometimes be referred to as a case, may be formed of plastic, glass, ceramics, fiber composites, metal (e.g., stainless steel, aluminum, etc.), other suitable materials, or a combination of these materials. In some situations, housing 12 or parts of housing 12 may be formed from dielectric or other low-conductivity material. In other situations, housing 12 or at least some of the structures that make up housing 12 may be formed from metal elements.

In configurations for device 10 in which housing 12 is formed from conductive materials such as metal, antennas 40 may be mounted under the display cover layer for display 14 as shown in FIG. 1 (e.g., under inactive region 20) and/or antennas 40 may be mounted adjacent to one or more dielectric antenna windows in housing 12. During operation, radio-frequency antenna signals can pass through the portion of inactive region 20 of the display cover layer that overlaps antennas 40 and/or radio-frequency antenna signals can pass through other dielectric structures in device 10 such as antenna window structures. In general, antennas 40 may be located in any suitable location in device housing 12 (e.g., along the edges of display 14, in corners of device 10, under an antenna window or other dielectric structure on a rear surface of housing 12, etc.).

Device 10 may have a single antenna or multiple antennas. In configurations in which multiple antennas are present, the antennas may be used to implement an antenna array in which signals for multiple identical data streams (e.g., Code Division Multiple Access data streams) are combined to improve signal quality or may be used to implement a multiple-input-multiple-output (MIMO) antenna scheme that enhances performance by handling multiple independent data streams (e.g., independent Long Term Evolution data streams). Multiple antennas may also be used to implement an antenna diversity scheme in which device 10 activates and inactivates each antenna based on its real time performance (e.g., based on received signal quality measurements). In a device with wireless local area network wireless circuitry, the device may use an array of antennas 40 to transmit and receive wireless local area network signals (e.g., IEEE 802.11n traffic). Multiple antennas may be used together in both transmit and receive modes of operation or may only be used together during only signal reception operations or only signal transmission operations.

Antennas in device 10 may be used to support any communications bands of interest. For example, device 10 may include antenna structures for supporting wireless local area network communications such as IEEE 802.11 communications or Bluetooth® communications, voice and data cellular telephone communications, global positioning system (GPS) communications or other satellite navigation system communications, etc.

Figure 2:
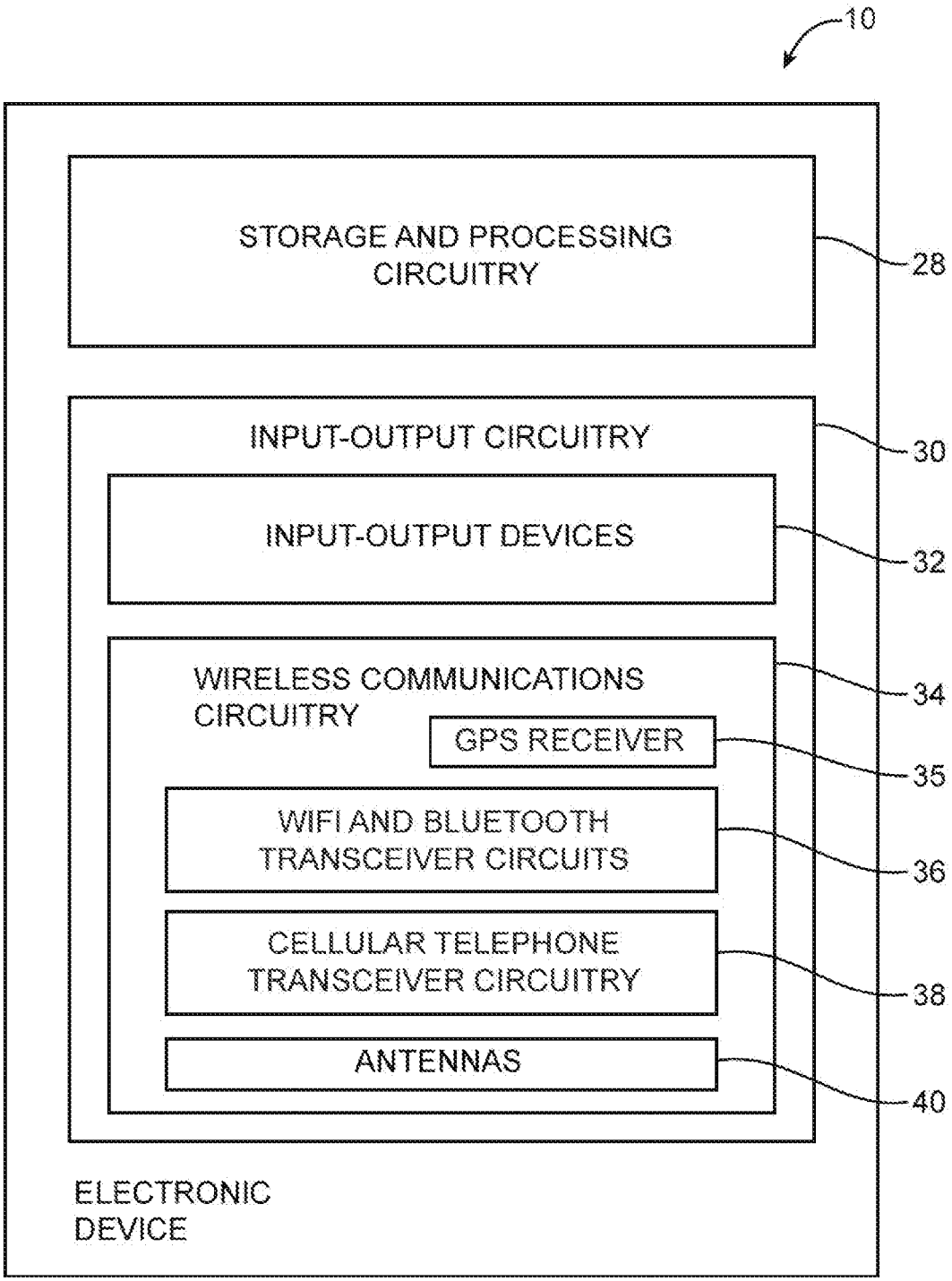
FIG. 2 is a schematic diagram of an illustrative electronic device with wireless communications circuitry in accordance with an embodiment of the present invention.

A schematic diagram of an illustrative configuration that may be used for electronic device 10 is shown in FIG. 2. As shown in FIG. 2, electronic device 10 may include control circuitry such as storage and processing circuitry 28. Storage and processing circuitry 28 may include storage such as hard disk drive storage, nonvolatile memory (e.g., flash memory or other electrically-programmable-read-only memory configured to form a solid state drive), volatile memory (e.g., static or dynamic random-access-memory), etc. Processing circuitry in storage and processing circuitry 28 may be used to control the operation of device 10. The processing circuitry may be based on one or more microprocessors, microcontrollers, digital signal processors, baseband processors, power management units, audio codec chips, application specific integrated circuits, etc.

Storage and processing circuitry 28 may be used to run software on device 10, such as internet browsing applications, voice-over-internet-protocol (VOIP) telephone call applications, email applications, media playback applications, operating system functions, etc. To support interactions with external equipment, storage and processing circuitry 28 may be used in implementing communications protocols. Communications protocols that may be implemented using storage and processing circuitry 28 include internet protocols, wireless local area network protocols such as IEEE 802.11 protocols—sometimes referred to as WiFi® and protocols for other short-range wireless communications links such as the Bluetooth® protocol, cellular telephone protocols, etc.

Input-output circuitry 30 may be used to allow data to be supplied to device 10 and to allow data to be provided from device 10 to external devices. Input-output circuitry 30 may include input-output devices 32. Input-output devices 32 may include touch screens, buttons, joysticks, click wheels, scrolling wheels, touch pads, key pads, keyboards, microphones, speakers, tone generators, vibrators, cameras, sensors, light-emitting diodes and other status indicators, data ports, etc. A user can control the operation of device 10 by supplying commands through input-output devices 32 and may receive status information and other output from device 10 using the output resources of input-output devices 32.

Wireless communications circuitry 34 may include radio-frequency (RF) transceiver circuitry formed from one or more integrated circuits, power amplifier circuitry, low-noise input amplifiers, passive RF components, one or more antennas, and other circuitry for handling RF wireless signals. Wireless signals can also be sent using light (e.g., using infrared communications).

Wireless communications circuitry 34 may include satellite navigation system receiver circuitry such as Global Positioning System (GPS) receiver circuitry 35 (e.g., for receiving satellite positioning signals at 1575 MHz) or satellite navigation system receiver circuitry associated with other satellite navigation systems. Transceiver circuitry 36 may handle 2.4 GHz and 5 GHz bands for WiFi® (IEEE 802.11) communications and may handle the 2.4 GHz Bluetooth® communications band. Circuitry 34 may use cellular telephone transceiver circuitry 38 for handling wireless communications in cellular telephone bands such as bands in frequency ranges of about 700 MHz to about 2200 MHz or bands at higher or lower frequencies. Wireless communications circuitry 34 can include circuitry for other short-range and long-range wireless links if desired. For example, wireless communications circuitry 34 may include wireless circuitry for receiving radio and television signals, paging circuits, near field communications circuitry, etc. In WiFi® and Bluetooth® links and other short-range wireless links, wireless signals are typically used to convey data over tens or hundreds of feet. In cellular telephone links and other long-range links, wireless signals are typically used to convey data over thousands of feet or miles.

Wireless communications circuitry 34 may include one or more antennas 40. Antennas 40 may, if desired, have conductive structures such as ground plane structures that form a conductive cavity and may therefore sometimes be referred to as cavity-backed antennas or cavity antennas. Cavities may be formed using rectangular box-shaped conductive structures, cavity structures with combinations of straight and curved conductive sidewalls, or cavity structures of other suitable shapes.

Figure 3:
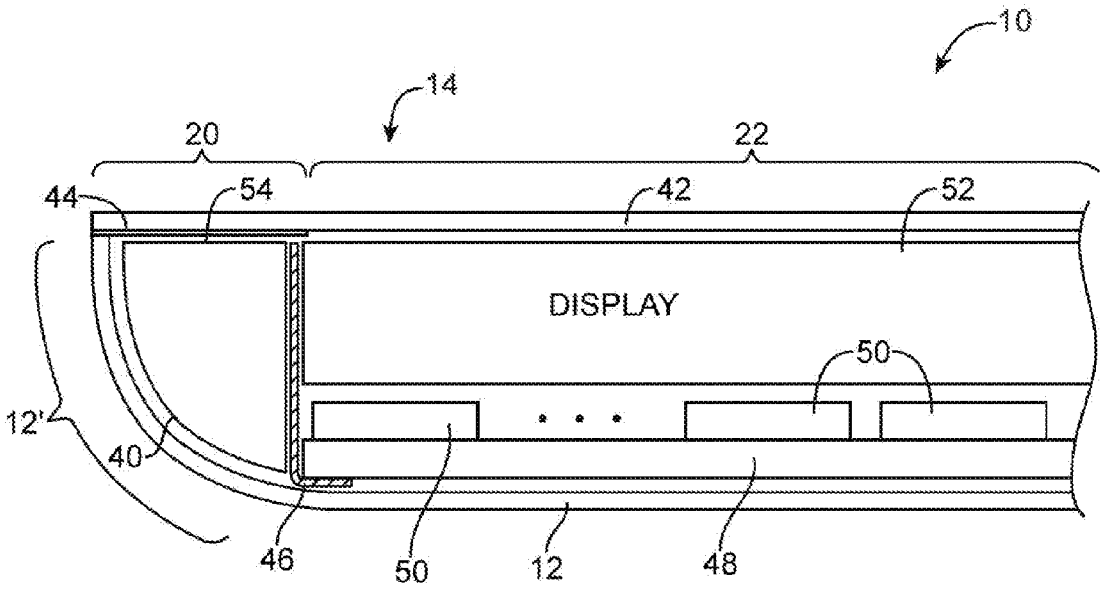
FIG. 3 is a cross-sectional side view of a portion of an electronic device showing how the device may be provided with an antenna in accordance with an embodiment of the present invention.

FIG. 3 is a cross-sectional side view of a portion of device 10. In the illustrative configuration of FIG. 3, antenna 40 has been formed along one of the edges of device housing 12 under inactive portion 20 of display 14. Display structures 52 (e.g., an array of image pixels for displaying images for the user of device 10) may be mounted under display cover layer 42 of display 14 in the center of device housing 12 (i.e., under active region 22 of display 14). In inactive display region 20, the interior surface of display cover layer 42 may be covered with opaque masking material 44 to block internal structures such as antenna 40 from view by a user of device 10. Housing 12 may have a planar rear housing wall. Housing 12 may have vertical sidewalls that run perpendicular to the planar rear housing wall or may, as shown in FIG. 3, have curved sidewalls that extend vertically upwards from the planar rear housing wall.

Device 10 may include one or more substrates such substrate 48 on which electrical components 50 are mounted. Electrical components 50 may include integrated circuits, discrete components such as resistors, inductors, and capacitors, switches, connectors, light-emitting diodes, and other electrical devices for forming circuitry such as storage and processing circuitry 28 and input-output circuitry 30 of FIG. 2.

Substrate 48 may be formed from a dielectric such as plastic. If desired, substrate 48 may be implemented using one or more printed circuits. For example, substrate 48 may be a flexible printed circuit ("flex circuit") formed from a flexible sheet of polyimide or other polymer layer or may be a rigid printed circuit board (e.g., a printed circuit board formed from fiberglass-filled epoxy). Substrate 48 may include conductive interconnect paths such as one or more layers of patterned metal traces for routing signals between components 50, antennas such as antenna 40, and other circuitry in device 10.

Upper surface 54 of antenna 40 may include patterned conductive structures such as patterned metal traces on a printed circuit or plastic carrier. Conductive sidewall and rear wall structures may be used in forming a conductive cavity for antenna 40. For example, the surfaces of a plastic carrier other than upper surface 54 may be covered with metal ground plane structures (i.e., cavity walls). If desired, conductive cavity walls may also be formed from rigid or flexible printed circuit board structures, metal foil, or other conductive structures. In configurations in which antenna 40 is backed by a conductive cavity, the conductive cavity walls may form a ground plane that helps to insulate antenna 40 from performance variations due to variations in the distance between antenna 40 (e.g., patterned conductive traces on surface 54) and nearby conductive structures in device 10.

If desired, conductive sidewall and rear wall structures for antenna 40 may be formed from adjacent structures such as conductive housing wall portion 12', conductive shielding structures 46 (e.g., metal tape and other shielding structures), conductive components such as display structures 52, components 50, and printed circuit 48, etc. In general, antenna 40 may be provided with ground plane structures using metal traces on a dielectric support structure (e.g., a plastic carrier, a glass carrier, a ceramic carrier, etc.), metal traces on a printed circuit, metal structures such as sheet metal structures, wire structures, conductive components such as components 50 and display structures 52, housing structures such as housing 12, etc.

Figure 4:
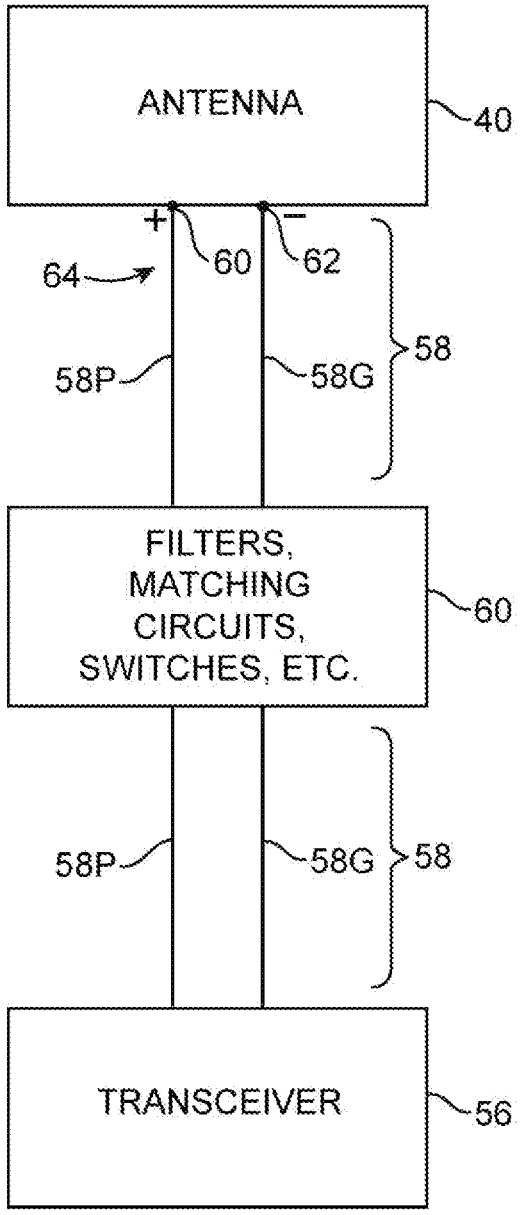
FIG. 4 is a diagram of an illustrative antenna coupled to a radio-frequency transceiver in accordance with an embodiment of the present invention.

FIG. 4 is a diagram showing how antenna 40 may be coupled to radio-frequency transceiver circuitry 56 using transmission line structures such as transmission line path 58. Radio-frequency transceiver circuitry 56 may include transceiver circuits such as satellite navigation system receiver circuitry 35, wireless local area network transceiver circuitry 36, and cellular telephone transceiver circuitry 38. Antenna 40 may have an antenna feed such as antenna feed 64 to which transmission line 58 is coupled. Antenna feed 64 may have a positive antenna feed terminal such as positive antenna feed terminal 60 that is coupled to positive transmission line conductor 58P in transmission line 58. Antenna feed 64 may also have a ground antenna feed terminal such as ground antenna feed terminal 62 that is coupled to ground transmission line conductor 58G in transmission line 58.

Transmission line 58 may be formed from a coaxial cable, a microstrip transmission line structure, a stripline transmission line structure, a transmission line structure formed on a rigid printed circuit board or flexible printed circuit board, a transmission line structure formed from conductive lines on a flexible strip of dielectric material, or other transmission line structures. If desired, one or more electrical components such as components 60 may be interposed within transmission line 58 (i.e., transmission line 58 may have two or more segments). Components 60 may include radio-frequency filter circuitry, impedance matching circuits (e.g., circuits to help match the impedance of antenna 40 to that of transmission line 58), switches, and other circuitry.

In electronic devices such as devices with compact layouts, it can be challenging to satisfy antenna design requirements. The relatively small amount of space that is sometimes available for forming antenna structures may make it desirable to place ground plane structures in close proximity to antenna resonating element structures. The presence of ground structures within close proximity to antenna resonating element structures may, however, tend to reduce antenna bandwidth and make it difficult to achieve desired antenna bandwidth goals.

An antenna design that can be used in device 10 to overcome these challenges may have a monopole antenna structure that is capacitively coupled to a conductive structure to form an antenna loop.

Figure 5:
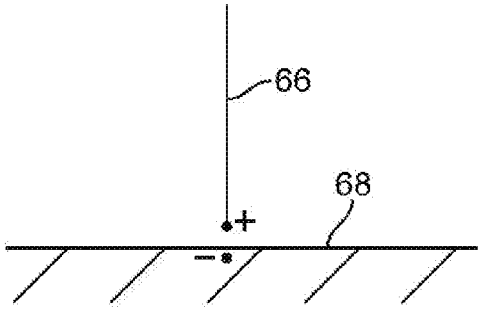
FIG. 5 is a diagram of an illustrative monopole antenna in accordance with an embodiment of the present invention.

FIG. 5 is a diagram of an illustrative monopole antenna. As shown in FIG. 5, a monopole antenna may have a monopole antenna resonating element such as monopole antenna resonating element 66 and an antenna ground such as antenna ground structure 68. The monopole antenna of FIG. 5 may have an antenna feed formed from a positive antenna feed terminal (+) and a ground antenna feed terminal (−). The positive antenna feed may be coupled to an end of the monopole antenna resonating element. The ground antenna feed may be formed on an opposing portion of the antenna ground.

Figure 6:
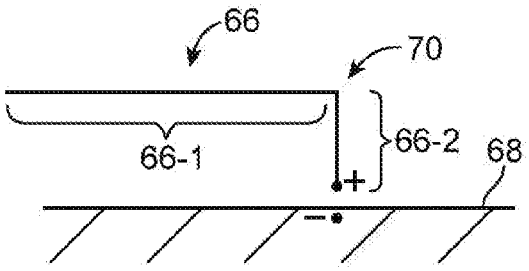
FIG. 6 is a diagram of an illustrative folded monopole antenna in accordance with an embodiment of the present invention.

Antenna resonating element 66 may, if desired, have one or more bends. A monopole antenna that has a bend is shown in FIG. 6. In the illustrative configuration of FIG. 6, monopole antenna resonating element 66 has bend 70. Bend 70 may be a right angle bend, a bend with an angle of about 70-110°, or other suitable bend. Bend 70 may be interposed between segments 66-2 and 66-1 of monopole antenna resonating element 66. As shown in FIG. 6, segment 66-2 of monopole antenna resonating element 66 may extend upwards (perpendicular to) the antenna ground structure 68 (e.g., perpendicular to the surface of a planar antenna ground structure or perpendicular to the edge of an antenna ground structure of other shapes). Segment 66-1 of monopole antenna resonating element 66 may run parallel to antenna ground structure 68 (e.g., parallel to the surface or edge of antenna ground structure 68).

Figure 7:
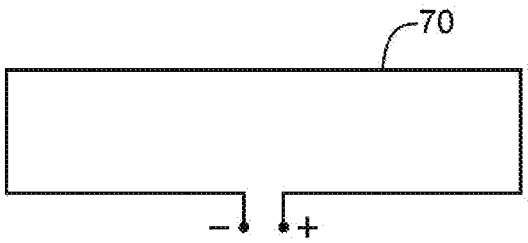
FIG. 7 is a diagram of an illustrative loop antenna in accordance with an embodiment of the present invention.

FIG. 7 is a diagram of an illustrative loop antenna. As shown in FIG. 7, a loop antenna may have a loop of conductive material such as loop conductor 70 that surrounds a central dielectric region. The loop antenna of FIG. 7 may have an antenna feed with a positive antenna feed terminal such as positive antenna feed terminal (+) and a ground antenna feed terminal such as ground antenna feed terminal (−). The illustrative loop antenna of FIG. 7 has a rectangular loop shape with two elongated edges and two perpendicular shorter edges. In general, a loop antenna may be circular in shape, may be oval in shape, may have straight sides, may have curved sides, or may have a loop shape that includes both curved and straight segments.

Figure 8:
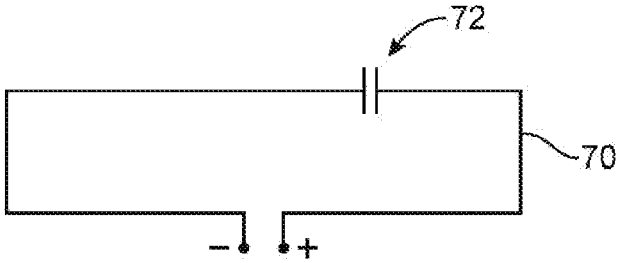
FIG. 8 is a diagram of an illustrative loop antenna having a conductive loop in which a capacitor has been interposed in accordance with an embodiment of the present invention.

As shown by the illustrative loop antenna of FIG. 8, a capacitor such as capacitor 72 may be interposed within the loop conductor of a loop antenna.

Figure 9:
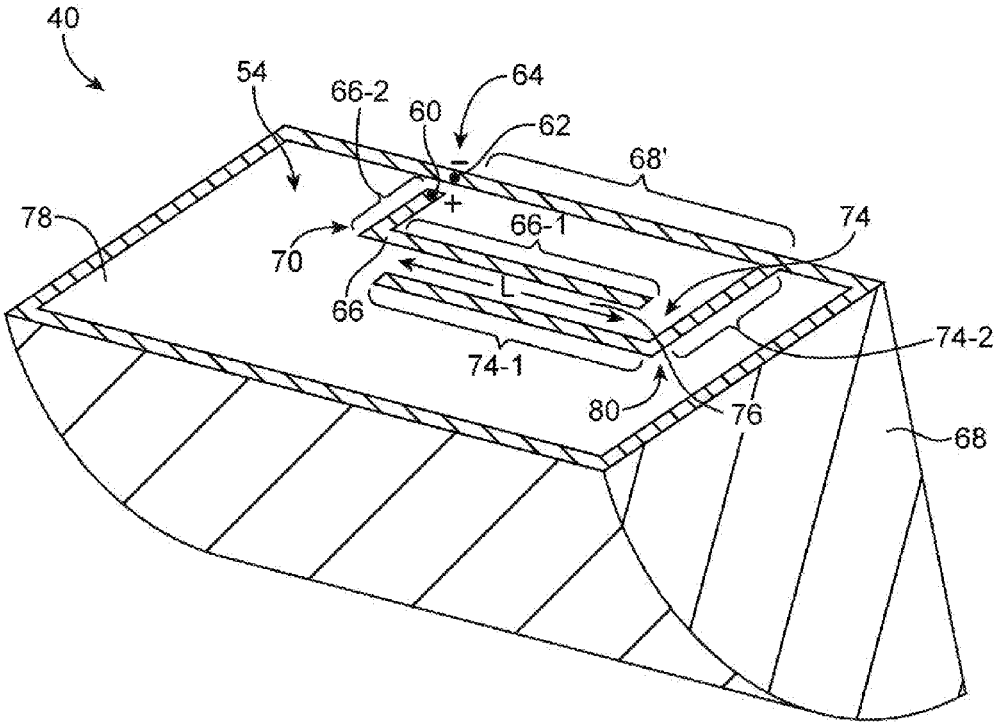
FIG. 9 is a front perspective view of an illustrative antenna having a folded monopole structure and an L-shaped conductive element that is capacitively coupled to the folded monopole structure in accordance with an embodiment of the present invention.

FIG. 9 is a diagram showing an illustrative configuration that may be used for one or more of antennas 40. As shown in FIG. 9, antenna 40 may be formed from a monopole antenna structure such as monopole antenna resonating element 66 that is capacitively coupled to a conductive structure that forms an antenna loop such as L-shaped structure 74 (e.g., a strip of metal or other conductive strip with a bend).

Antenna 40 of FIG. 9 may have a dielectric support structure such as dielectric support structure 78. Conductive structures such as metal traces may be formed on dielectric support structure 78. The metal traces may include, for example, antenna ground structures 68 (e.g., structures on the sidewalls and lower wall of support structure 78) and patterned conductive structures on surface 54 of dielectric support structure 78 such as folded monopole antenna resonating element 66 and L-shaped conductive structure 74.

Antenna 40 may have an antenna feed such as antenna feed 64. Antenna feed 64 may have a positive antenna feed terminal such as positive antenna feed terminal 60 that is coupled to one end of monopole antenna resonating element 66 and may have a ground antenna feed terminal such a ground antenna feed terminal 62 that is coupled to an opposing portion of antenna ground structure 68. A gap may separate terminals 60 and 62.

Folded monopole antenna resonating element 66 may have a segment (arm) such as segment 66-1 and a segment (arm) such as segment 66-2. Segment 66-2 may lie perpendicular to adjacent edge portion 68' of antenna ground structure 68. Segment 66-1 may run parallel to the adjacent edge of antenna ground structure 68. Element 66 may have a bend such as bend 70 that is interposed between segments 66-1 and 66-2. Bend 70 may be a right angle bend, a bend with an angle of about 70-110°, or other suitable bend. Element 66 may have opposing ends. One end of element 66 may be coupled to positive antenna feed terminal 60. The opposing end of folded monopole antenna resonating element 66 may be located at the end of segment 66-1, adjacent to conductive structure 74.

Conductive structure 74 may have a bend such as bend 80 (e.g., conductive antenna element structure 74 may be formed from an L-shaped bent strip of metal such as a trace on a printed circuit). Bend 80 may be a right angle bend, a bend with an angle of about 70-110°, or other suitable bend. Bend 80 may be interposed between segment (arm) 74-1 and segment (arm) 74-2 of conductive member 74. Segment 74-2 may have one end that is connected to ground 68 (i.e., an end that terminates at ground 68), so that segment 74-2 forms an extension of ground 68 and may have an opposing end that is adjacent to element 66. Segment 74-2 may lie perpendicular to adjacent edge portion (segment) 68' of antenna ground structure 68. Segment 74-1 may run parallel to adjacent edge portion 68' of antenna ground structure 68 and parallel to segment 66-1 of folded monopole antenna resonating element 66.

Folded monopole antenna resonating element 66 and conductive antenna structure 74 may have opposing portions that are separated by a gap such as gap 76. In the configuration of FIG. 9, for example, at least some of segment 66-1 runs parallel to an opposing length of segment 74-1. These opposing conductive structures give rise to a capacitance C that capacitively couples element 66 and structure 74. In particular, segment 66-1 and opposing segment 74-1 may form respective capacitor electrodes that are separated by gap 76. The magnitude of capacitance C is a function of the amount of overlap L between segment 66-1 and segment 74-1 and the size of gap 76 (i.e., the width W of gap 76 transverse to overlap length L). Increases in L and decreases in the width of gap 76 will tend to increase the value of capacitance C.

Figure 10:
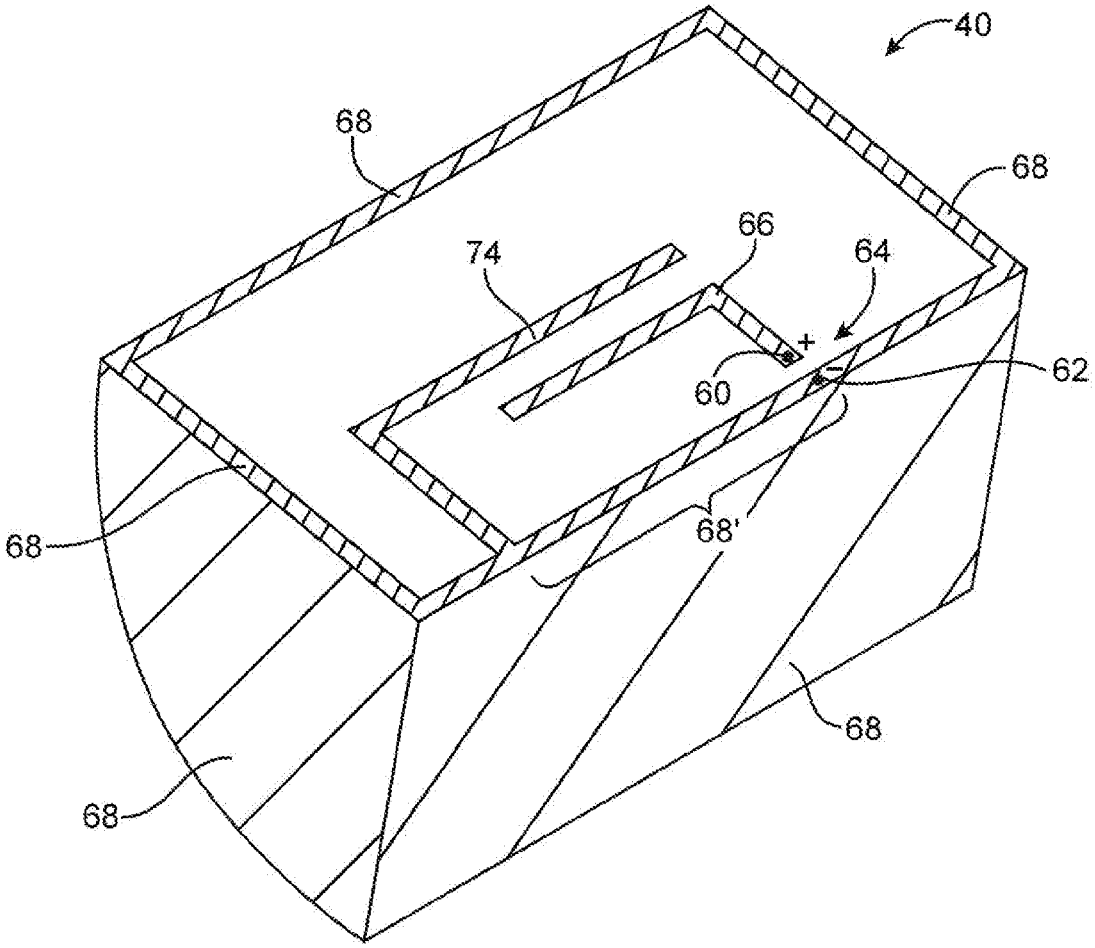
FIG. 10 is a rear perspective view of an illustrative antenna of the type shown in FIG. 9 in accordance with an embodiment of the present invention.

Antenna ground structures 68 may extend around the sidewalls of support structure 68 and may cover the underside of structure 68, thereby forming an antenna cavity for antenna 40. If desired, ground 68 may have portions that run around the periphery of upper surface 54 of antenna 40 as shown in FIG. 9 (e.g., to form a ground with a rectangular opening or an opening of other shapes). Folded monopole antenna resonating element 66 and L-shaped conductive element 74 may be formed within the opening in ground 68 on upper antenna surface 54. For example, elements 66 and 74 may lie within a rectangular opening or an opening of other shape that is formed by the portions of ground 68 at the top of structure 78. Elements 66 and 74 may be formed on structure 78 directly or may be formed on a printed circuit or other substrate that is mounted to the planar upper surface of support structure 78. FIG. 10 is a rear perspective view of antenna 40 and support structure 78 showing how antenna ground 68 may cover substantially all of the surfaces of antenna support structure 78 other than the opening on upper surface 54.

Figure 11:
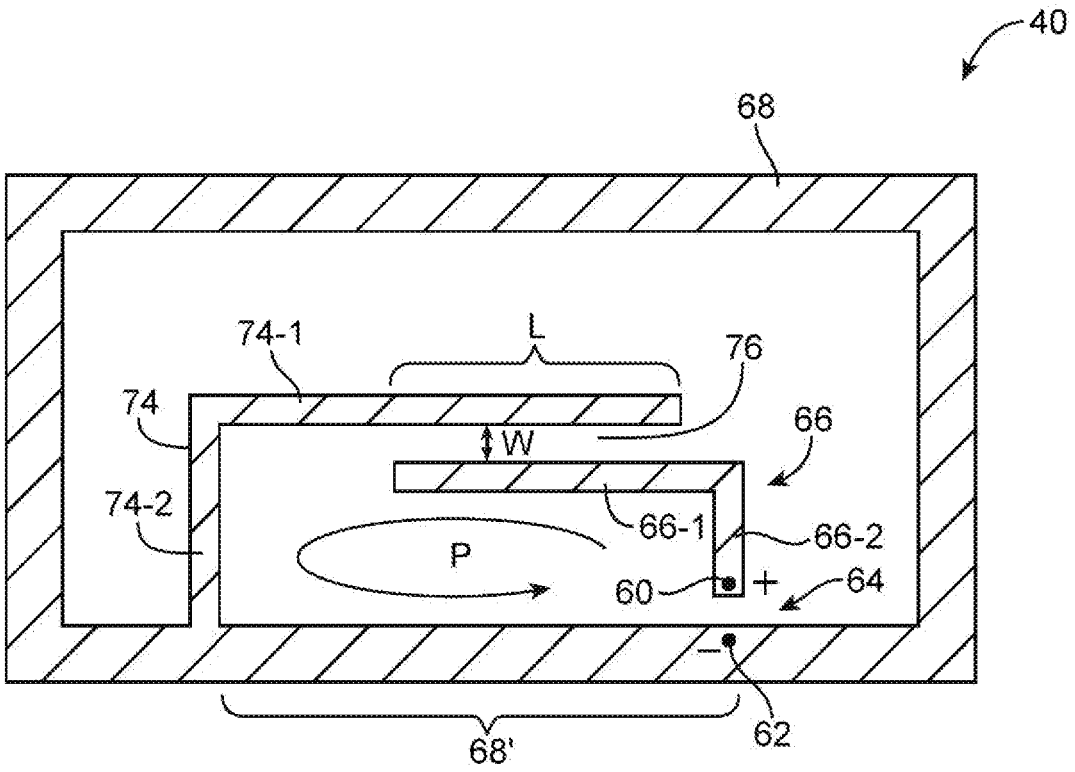
FIG. 11 is a top view of an illustrative antenna of the type shown in FIG. 10 in accordance with an embodiment of the present invention.

FIG. 11 is a top view of antenna 40. As shown in FIG. 11, segment 66-1 of folded monopole antenna resonating element 66 and segment 74-1 of L-shaped conductive antenna element 74 may be separated by gap 76 of width W along an overlapping region of length L. This gives rise to a capacitance C between element 66 and element 74. Element 66, element 74, and portion 68' of ground 68 may form three portions (i.e., segments) of an antenna. For example, the conductive antenna segment formed from element 66, the conductive antenna segment formed from element 74, and the conductive antenna segment formed from ground segment 68' may form three lengths of antenna conductor in an antenna such as the antenna of FIG. 8.

The positive antenna feed terminal (+) of the antenna feed of the FIG. 8 antenna may correspond to positive antenna feed terminal 60 of antenna 40, the ground antenna feed terminal (−) of the antenna feed of the FIG. 8 antenna may correspond to ground antenna feed terminal 62 of antenna 40, and conductive loop 70 of the antenna of FIG. 8 may be formed by elements 66 and 74 and ground segment 68'. Capacitor 72 of the antenna of FIG. 8 may correspond to the capacitor of capacitance C that is formed by the overlap of element 66 and element 74 (i.e., capacitor 72 may be interposed between element 66 and 74). If desired, the capacitance C between elements 66 and 74 may be implemented by attaching one or more discrete components such as capacitors between element 66 and 74. The use of a distributed capacitor arrangement of the type shown in FIG. 11 is merely illustrative.

The capacitive coupling between folded monopole antenna resonating element 66 and L-shaped conductor 74 allows antenna 40 to operate in different modes at different frequencies. Consider, as an example, a scenario in which it is desired to operate antenna 40 over a range of frequencies including lower frequency $f_L$ and higher frequency $f_H$. It may, for example, be desirable to use antenna 40 for operations in multiple communications bands such as a first communications band centered at frequency $f_L$ and a second communications band centered at frequency $f_H$.

At lower frequencies, such as frequencies in the vicinity of lower frequency $f_L$, the impedance of capacitance C between element 66 and structure 74 (e.g., the impedance associated with capacitance C of the antenna of FIG. 8) may be relatively large. This relatively large impedance may effectively isolate conductive structure 74 from folded monopole antenna resonating element 66. At these lower frequencies, antenna 40 may therefore operate as a monopole antenna such as the folded monopole antenna of FIG. 6.

At higher frequencies, such as frequencies in the vicinity of higher frequency $f_H$, the impedance associated with capacitance C between element 66 and structure 74 may be relatively small. In this situation, element 66 may effectively be shorted to structure 74 and the performance of antenna 40 may be influenced by two operating modes.

The first of the two high band modes that may contribute to the performance of antenna 40 in the vicinity of higher frequency $f_H$ may be a folded monopole mode. The length of folded monopole antenna resonating element 66 may be configured to be about a quarter of a wavelength at frequency $f_H$ to support operation in this mode.

The second of the two high band modes that may contribute to the performance of antenna 40 in the vicinity of higher frequency $f_H$ may be a harmonic loop antenna mode. In this mode, a harmonic of a loop antenna resonance associated with the loop antenna structure of FIG. 8 (i.e., a harmonic of the conductive antenna loop formed from segments 66, 74, and 68') may contribute to the antenna performance of antenna 40.

Figure 12:
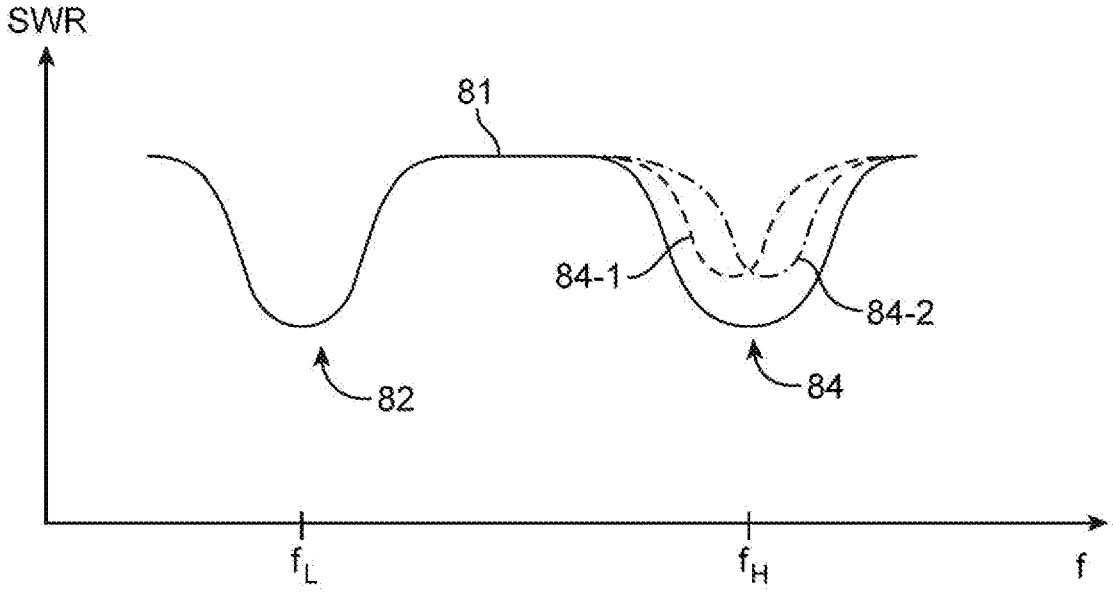
FIG. 12 is a graph in which antenna performance (standing-wave ratio) for an antenna of the type shown in FIGS. 9 and 10 has been plotted as a function of operating frequency in accordance with an embodiment of the present invention.

FIG. 12 is a graph in which antenna performance (i.e., standing wave ratio (SWR)) has been plotted as a function of frequency for an antenna of the type shown in FIGS. 8, 9, and 10. As shown by trace 81 of FIG. 12, antenna 40 may exhibit a first resonance (resonant peak 82) centered about frequency $f_L$ (e.g., when antenna 40 is operating in the folded monopole mode). At frequencies around frequency $f_H$, antenna 40 may exhibit a second resonance (resonant peak 84). Resonant peak 84 may have two contributions, as indicated by peaks 84-1 and 84-2. These contributions may correspond to a folded monopole resonance and a harmonic loop antenna resonance. Because peaks 84-1 and 84-2 overlap but are located at slightly different frequencies (in this example), the overall bandwidth of resonant peak 84 may be enhanced.

The ability of antenna 40 to exhibit multiple resonances and to exhibit multiple resonant contributions to the high band resonance 84 may help antenna 40 to exhibit satisfactory operation, even in electronic devices with confined antenna volumes and adjacent conductive structures. Antennas 40 may exhibit satisfactory isolation from other antennas due to the loop-type current distribution associated with loop mode operations (i.e., antennas 40 may be relatively self contained).

The foregoing is merely illustrative of the principles of this invention and various modifications can be made by those skilled in the art without departing from the scope and spirit of the invention.

What is claimed is:

1. An antenna for an electronic device, comprising:

a monopole antenna resonating element; and conductive structures that are capacitively coupled to the monopole antenna resonating element, wherein the monopole antenna resonating element and conductive structures are configured to exhibit at least one monopole antenna resonance and at least one loop antenna resonance, wherein the conductive structures comprise a portion of an antenna ground, and wherein the antenna ground comprises metal that forms an antenna cavity.

2. The antenna defined in claim 1 wherein the monopole antenna resonating element comprises a folded monopole antenna resonating element.

3. The antenna defined in claim 1 wherein the monopole antenna resonating element has opposing first and second ends, wherein the antenna comprises an antenna feed having a positive antenna feed terminal at the first end and having a ground antenna feed terminal.

4. The antenna defined in claim 3 wherein the monopole antenna resonating element comprises a folded monopole antenna resonating element having first and second segments with an interposed bend.

5. The antenna defined in claim 1 wherein the conductive structures comprise an L-shaped conductive element.

6. The antenna defined in claim 5 wherein the L-shaped conductive element has a first segment and a second segment and has a bend interposed between the first segment and the second segment and wherein the first segment runs parallel to at least a portion of the monopole antenna resonating element.

7. The antenna defined in claim 6 wherein conductive structures that are capacitively coupled to the monopole antenna resonating element are characterized by a capacitance between the conductive structures and the monopole antenna resonating element and wherein the portion of the monopole antenna resonating element and the first segment of the L-shaped conductive element are separated by a gap that gives rise to the capacitance.

8. The antenna defined in claim 7 further comprising a support structure, wherein at least part of the antenna ground is formed on the support structure.

9. The antenna defined in claim 8 wherein the support structure has a planar surface on which the monopole antenna resonating element and the L-shaped conductive element are located and wherein metal of the antenna ground covers substantially all of the support structure except the planar surface to form the antenna cavity.

10. The antenna defined in claim 1 wherein the conductive structures comprise a bent conductive element having a portion that is separated from a portion of the monopole antenna resonating element by a gap that produces a capacitance between the bent conductive element and the monopole antenna resonating element.

11. The antenna defined in claim 10 wherein the conductive structures comprise an antenna ground having a portion that is coupled to the bent conductive element.

12. The antenna defined in claim 11 wherein the antenna resonating element comprises a folded monopole antenna resonating element having opposing first and second ends, wherein the antenna comprises a feed having a feed terminal on the first end of the folded monopole antenna resonating element, and wherein the bent conductive element comprises an L-shaped conductive element with a first end terminated at the portion of the antenna ground and a second end adjacent to the folded monopole antenna element.

13. An antenna for an electronic device, comprising:

an antenna ground having an opening;

a monopole antenna resonating element in the opening; and a conductive antenna element in the opening, wherein the conductive antenna element and the monopole antenna resonating element are capacitively coupled.

14. The antenna defined in claim 13 wherein the monopole antenna resonating element has opposing first and second ends, the antenna further comprising an antenna feed having a first antenna feed terminal coupled to the first end of the monopole antenna resonating element and having a second antenna feed terminal coupled to the antenna ground.

15. The antenna defined in claim 14 wherein the antenna ground has a portion coupled between the conductive antenna element and the second antenna feed terminal.

16. The antenna defined in claim 15 further comprising a dielectric support structure having a planar surface on which the opening, the monopole antenna resonating element, and the conductive antenna element are located.

17. The antenna defined in claim 16 wherein the antenna ground is configured to cover the dielectric support structure except in the opening.

18. The antenna defined in claim 17 wherein the antenna ground and dielectric support structure are configured to form a cavity for the antenna, and wherein the opening comprises a rectangular opening on the surface of the dielectric support structure.

19. The antenna defined in claim 18 wherein the monopole antenna resonating element comprises a first segment, a second segment, and a bend interposed between the first segment and the second segment, wherein the conductive antenna element comprises an L-shaped element having a first segment, a second segment, and a bend interposed between the first segment and the second segment, and wherein the portions of the monopole antenna resonating element and conductive antenna element that run parallel to each other comprise portions of the second segment of the monopole antenna resonating element and the second segment of the conductive antenna element.

20. The antenna defined in claim 19 wherein the first segment of the monopole antenna resonating element is coupled to a positive antenna feed terminal and wherein the first segment of the conductive antenna element has an end that terminates at the antenna ground.

21. The antenna defined in claim 13 wherein the monopole antenna resonating element and the conductive antenna element comprise portions that run parallel to each other and that are separated by a gap to create a capacitance between the monopole antenna resonating element and the conductive antenna element that capacitively couples the monopole antenna resonating element and the conductive antenna element.

22. An antenna comprising:

a dielectric support structure having at least some sidewalls and a surface;

an antenna ground that covers the sidewalls and that is configured to form an opening on the surface;

a folded monopole antenna resonating element in the opening; and a conductive antenna element in the opening that is capacitively coupled to the folded monopole antenna resonating element.

23. The antenna defined in claim 22 wherein the conductive antenna element comprises a bent strip of metal having a first end that terminates at the antenna ground and an opposing second end that is separated from the folded monopole antenna element by a gap.

24. The antenna defined in claim 23 further comprising a first antenna feed terminal at an end of the folded monopole antenna resonating element and a second antenna feed terminal on the antenna ground, wherein the antenna ground has a portion that extends between the second antenna feed terminal and the first end of the bent strip of metal and wherein the monopole antenna resonating element and conductive structures are configured to exhibit at least one monopole antenna resonance associated with the folded monopole antenna resonating element and at least one loop antenna resonance associated with a loop formed from the folded monopole antenna resonating element, the bent strip of metal, and the portion of the antenna ground.

* * * * *